US005126628A

United States Patent [19]

Kishimoto et al.

[11] Patent Number: 5,126,628

[45] Date of Patent: Jun. 30, 1992

[54] FLAT PANEL COLOR DISPLAY

[75] Inventors: Shunichi Kishimoto, Kaizuka; Yasuo Funazo, Hirakata; Katsumi Terada, Kyoto; Goro Hamagishi, Toyonaka; Kazuhiko Takeuchi, Ikeda; Daisuke Takemori, Suita; Takashi Ikeda, Suita, all of Japan

[73] Assignee: Sanyo Electric Co., Ltd., Japan

[21] Appl. No.: 737,896

[22] Filed: Jul. 26, 1991

Related U.S. Application Data

[63] Continuation of Ser. No. 437,560, Nov. 17, 1989, abandoned.

[30] Foreign Application Priority Data

| | | | |
|---|---|---|---|
| Nov. 18, 1988 | [JP] | Japan | 63-293423 |
| Dec. 20, 1988 | [JP] | Japan | 63-322554 |
| Mar. 20, 1989 | [JP] | Japan | 1-68057 |
| Apr. 26, 1989 | [JP] | Japan | 1-106260 |

[51] Int. Cl.[5] ..... H01J 31/00; H01J 29/46; H01J 29/10; H01J 1/46

[52] U.S. Cl. ..... 313/482; 313/422; 313/452; 313/470; 313/296; 313/302

[58] Field of Search ..... 313/482, 422, 452, 296, 313/302, 470

[56] References Cited

U.S. PATENT DOCUMENTS

| | | | |
|---|---|---|---|
| 3,935,500 | 1/1976 | Oess et al. | 313/302 X |
| 4,020,381 | 4/1977 | Oess et al. | 313/302 |
| 4,091,306 | 5/1978 | Hant | 313/302 X |
| 4,118,651 | 10/1978 | Scott . | |
| 4,121,130 | 10/1978 | Gange | 313/302 |
| 4,163,949 | 8/1979 | Shelton | 313/302 X |
| 4,556,620 | 12/1985 | Thompson | 313/470 |
| 4,622,497 | 11/1986 | Miyama et al. . | |
| 4,719,388 | 1/1988 | Oess | 313/302 X |

FOREIGN PATENT DOCUMENTS

| | | |
|---|---|---|
| 0107217 | 5/1984 | European Pat. Off. . |
| 3339696A1 | 4/1984 | Fed. Rep. of Germany . |

OTHER PUBLICATIONS

Patent Abstracts of Japan, vol. 9, No. 131 (E-319)(1854) Jun. 6, 1985.

*Primary Examiner*—Donald J. Yusko
*Assistant Examiner*—Brian Zimmerman
*Attorney, Agent, or Firm*—Armstrong, Nikaido, Marmelstein, Kubovcik & Murray

[57] ABSTRACT

A flat display includes a front panel having a fluorescent screen on its rear side, a rear panel defining a flat space with the front panel, linear filament cathodes arranged close to the rear panel, and an address electrode plate having a multiplicity of apertures and disposed close to the front panel. The rear panel is formed on its inner surface with spacer ridges each extending on each side of each filament cathode therealong and having a height to reach the address electrode plate. The spacer ridges give the flat display improved strength against pressure.

6 Claims, 14 Drawing Sheets

SEE FIG.1A
SEE FIG.1C
II
II
10
12
14
16
18
24
25
26
28
30

FLAT PANEL COLOR DISPLAY

This application is a continuation of application Ser. No. 437,560 filed Nov. 17, 1989 now abandoned.

FIELD OF THE INVENTION

The present invention relates to devices for displaying images by exciting phosphors on a display panel with electron beams, and more particularly to flat displays suitable for use in large-screen television receivers.

BACKGROUND OF THE INVENTION

Research is conducted on flat displays having a large screen for use as displays for high definition television. CRTs generally in use as display devices are most excellent in respect of the quality of images since a high-speed electron beam is projected on phosphors for excitation. However, high definition television receivers of 40 inches or larger comprising such a display device exceed 170 kg in weight and 850 mm in depth and are not suited to household use.

Accordingly, U.S. Pat. No. 4,719,388 or Unexamined Japanese Patent Publication SHO 61-242489 discloses a flat display of the electron beam type which comprises linear filament cathodes -serving as electron beam emitters and in which the high-speed electron beams derived by XY matrix electrodes are adapted impinge on specified addresses on a fluorescent screen.

FIG. 16 shows the construction of the flat display disclosed in the U.S. patent. The display comprises a front panel 10 having a fluorescent screen on its rear surface, a rear panel 16 having a back electrode 32 on its inner surface, linear filament cathodes 14 and an address electrode plate 12 arranged in a flat space defined by the two panels, and a gridlike accelerating electrode 42 disposed between and in parallel to the filament cathodes 14 and the address electrode plate 12. The address electrode plate 12 comprises first address electrodes 26 formed on one surface of a substrate and extending in one direction of an XY matrix, and second address electrodes 28 formed on the other surface of the substrate 25 and extending in the other direction of the XY matrix, i.e. in a direction perpendicular to the address electrodes 26. The address electrode plate 12 is formed with apertures 24 at the respective intersections. When a positive voltage is applied to selected two electrodes 26, 28 at the same time, an electron beam is drawn through the aperture 24 positioned at the intersection of these electrodes to impinge on the specified address of the fluorescent screen on the front panel 10 to which a high voltage is applied, thereby causing luminescence.

This device operates on basically the same principle as the CRT and therefore gives images of higher quality than flat displays of other types, such as plasma display panel (PDP) type, liquid crystal display (LCD) type, and vacuum fluorescent display (VFD) type.

In the case of the flat display of the electron beam type, the interior of the display is maintained in a vacuum of $10^{-6}$ torr, so that the atmospheric pressure exerts a great compressive force on the front and rear panels and is likely to cause implosion. If small-sized, the display can be given the required pressure resistance by increasing the thickness of the glass panels, whereas with the large display of the construction shown in FIG. 16, the increase in the thickness of the panels entails the problem of a greatly increased weight.

SUMMARY OF THE INVENTION

An object of the present invention is to provide a flat display of the electron beam type which can be prevented from implosion without increasing the thickness of the glass panels thereof.

Another object of the present invention is to provide a flat display of the electron beam type wherein irregularities in the luminescence of the screen are inhibited to give images of improved equality.

The flat display of the present invention comprises a front panel 10 having a fluorescent screen on its rear surface, a rear panel 16, a plurality of linear filament cathodes 14 arranged in a flat space defined by the two panels and adjacent to the rear panel, and an address electrode plate 12 disposed in the flat space and adjacent to the front panel. The address electrode plate 12 has a plurality of first address electrodes 26 formed on one surface of a substrate 25, a plurality of second address electrodes 28 formed on the other surface of the substrate and extending in a direction intersecting the first address electrodes at right angles therewith, and one or a plurality of apertures 24 formed in the area of intersection of each first electrode and each second electrode. The rear panel 16 is formed on its inner surface with a plurality of spacer ridges 30 extending along the linear filament cathodes 14 and having a height to reach the address electrode plate 12.

Further according to the invention, a spacer panel 36 supporting the front panel 10 is provided on the surface of the address electrode plate 12 opposite to the surface thereof adjacent to the filament cathodes 14. The spacer panel 36 is formed over the entire area thereof with apertures 38 positioned in coincidence with the respective apertures 24.

For example, in the case where phosphor dots 18 of the three primary colors of red, blue and green form the fluorescent screen, the apertures 24, 38 in the address electrode plate 12 and the spacer panel 36 are formed in corresponding relation to the respective phosphor dots 18.

The filament cathodes 14 emit electrons at all times. When an address signal voltage is applied to selected two address electrodes 26, 28 of the electrode plate 12, electrons are drawn from the cathode 14 closest to the aperture 24 at the addressed position and are caused to impinge on the corresponding position on the fluorescent screen via the aperture 24 in the electrode plate 12.

When each filament cathode 14 is provided for a plurality of rows of phosphor dots with two spacer ridges 30 formed on respective opposite sides of each cathode 14, electrons released from the single cathode impinge not only on the phosphor dot immediately above the cathode but also on the phosphor dot positioned as opposed to a side portion of the area defined by the two spacer ridges, forming a bent electron orbit from the cathode toward the aperture at the addressed position. Thus, the electrons impinge on the contemplated phosphor dot with a sufficient area of irradiation. Therefore, the single cathode is operable over an increased area for the region defined by the spacer ridges. Since the cathodes can be disposed close to the address electrode plate also in this case, the above arrangement is not an obstacle to the reduction in the thickness of the display.

The spacer ridges 30 on the rear panel supports the address electrode plate 12 thereon to maintain a definite spacing between the cathodes 14 and the electrode plate 12 and limit the movement of electrons released from each cathode 14 to the region between the spacer ridges 30, 30 at opposite sides of the cathode, thereby preventing the electrons from moving into the next region beyond the spacer ridge 30.

Moreover, the spacer ridges on the inner surface of the rear panel give enhanced mechanical bending strength to improve the pressure resistance of the panel to the compression due to the atmospheric pressure.

In the case where the spacer panel 36 is provided, the electron beam 40 passes through the two communicating apertures 24, 38 to impinge on the fluorescent screen to cause luminescence of the screen. The rear side of the front panel 10 is supported by the spacer panel 36, which itself is supported by the front ends of the spacer ridges 30 on the rear panel 16 through the address electrode plate 12. Accordingly, this construction gives remarkably improved pressure resistance to the two panels 10, 16 to prevent implosion.

At least one aperture 42 can be formed in the portion of the address electrode plate 12 where each address electrode 26 and each address electrode 28 intersect each other with the substrate 25 positioned therebetween.

For example even if one electrode is displaced from the other electrode when they are formed, at least one aperture 42 is invariably formed in the intersection, ensuring that the intersection has a region for electrons to pass through. Consequently, there remains no phosphor dot which will not luminesce. This assures images of high quality.

The spacer panel 36 can be formed over the entire area thereof with a plurality of apertures 44 which diminish in cross section from one side thereof adjacent to the address electrode plate 12 toward the other side thereof adjacent to the front panel.

In this case, the aperture 44 of the spacer panel 36 has a sufficiently large area opposed to the address electrode plate 12. This assures electrons of a region for them to pass through straight even if the spacer panel 36 is displaced from the electrode plate, obviating the likelihood that the electron beam passing through the electrode plate 12 will be blocked by the spacer panel 36. Consequently, no irregularities occur in luminescence despite the provision of the spacer panel 36.

Moreover, the aperture 44 in the spacer panel 36 decreases in size toward the front panel 10, so that even if the aperture is enlarged toward the electrode plate 12, the spacer panel 36 retains sufficient strength to exhibit sufficient resistance to the atmospheric pressure acting on the front panel 10 to prevent implosion.

BRIEF DESCRIPTION OF THE DRAWINGS

FIG. 12 is a diagram of an arrangement of rectangular apertures;

DETAILED DESCRIPTION OF EMBODIMENTS

Several preferred embodiments of the invention will be described below in detail.

Figures 1, 1A, 1B, 1C:
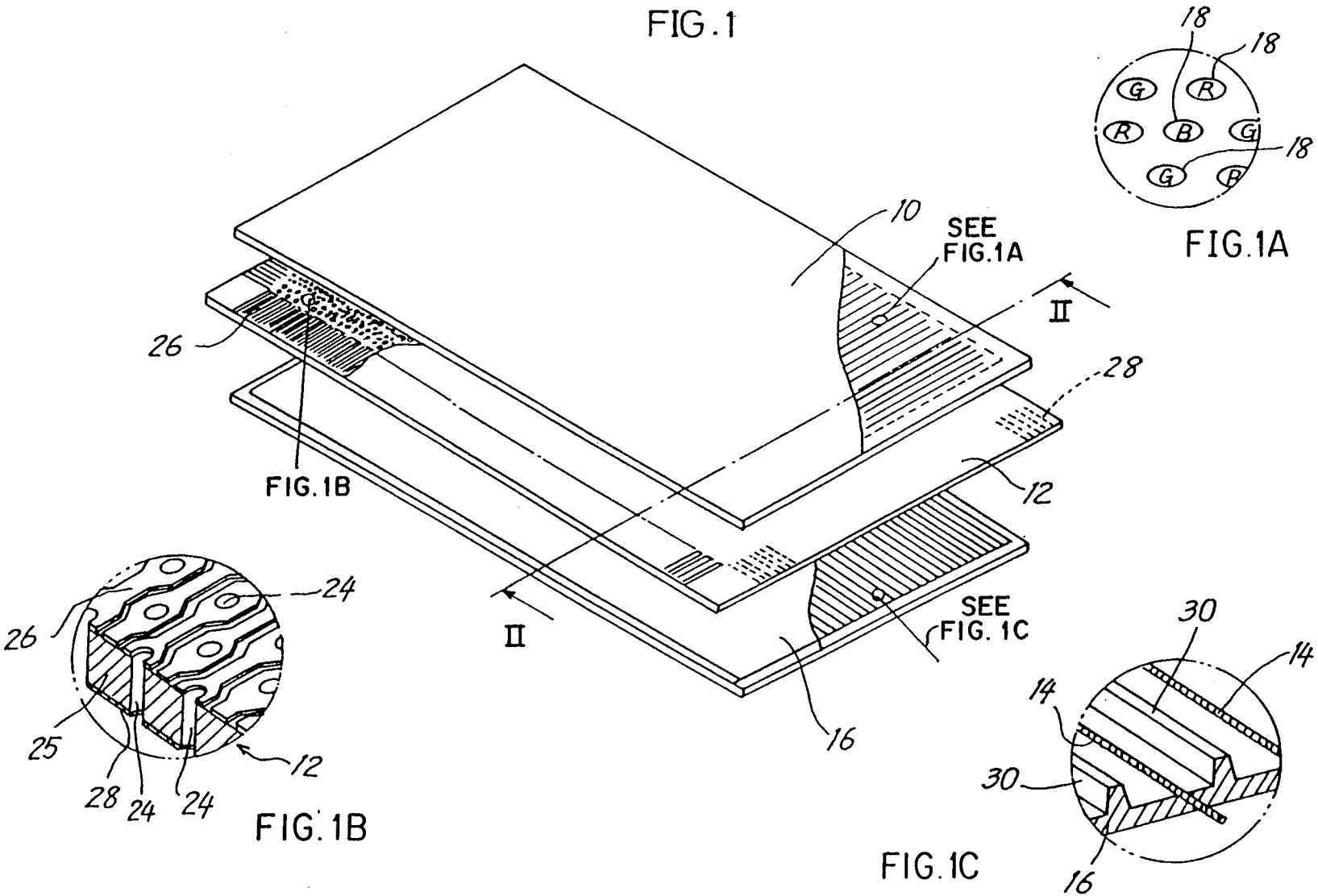
FIG. 1 is a perspective view showing a flat display of the invention as exploded and also showing main portions thereof on an enlarged scale.
FIG. 1A is a plan view showing the position of spacer ridges as related to an arrangement of phosphor dots.
Figure 1A:
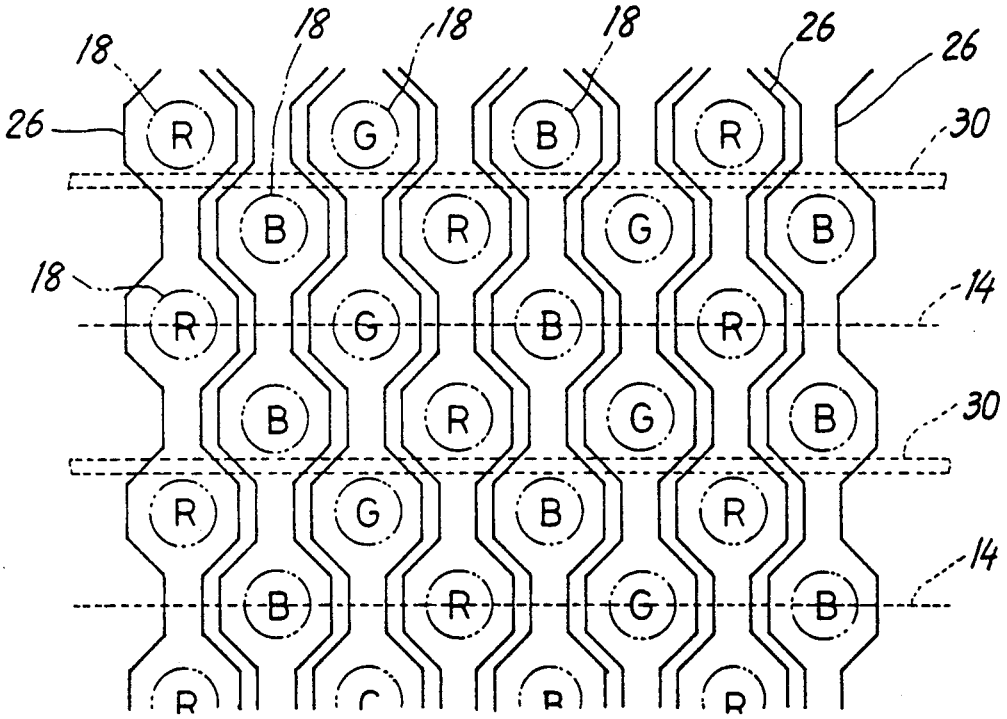

FIG. 1 shows a flat display embodying the invention and serving as a color display. The display comprises a front panel 10, a rear panel 16 and an address electrode plate 12 disposed between the two panels.

Figure 2:
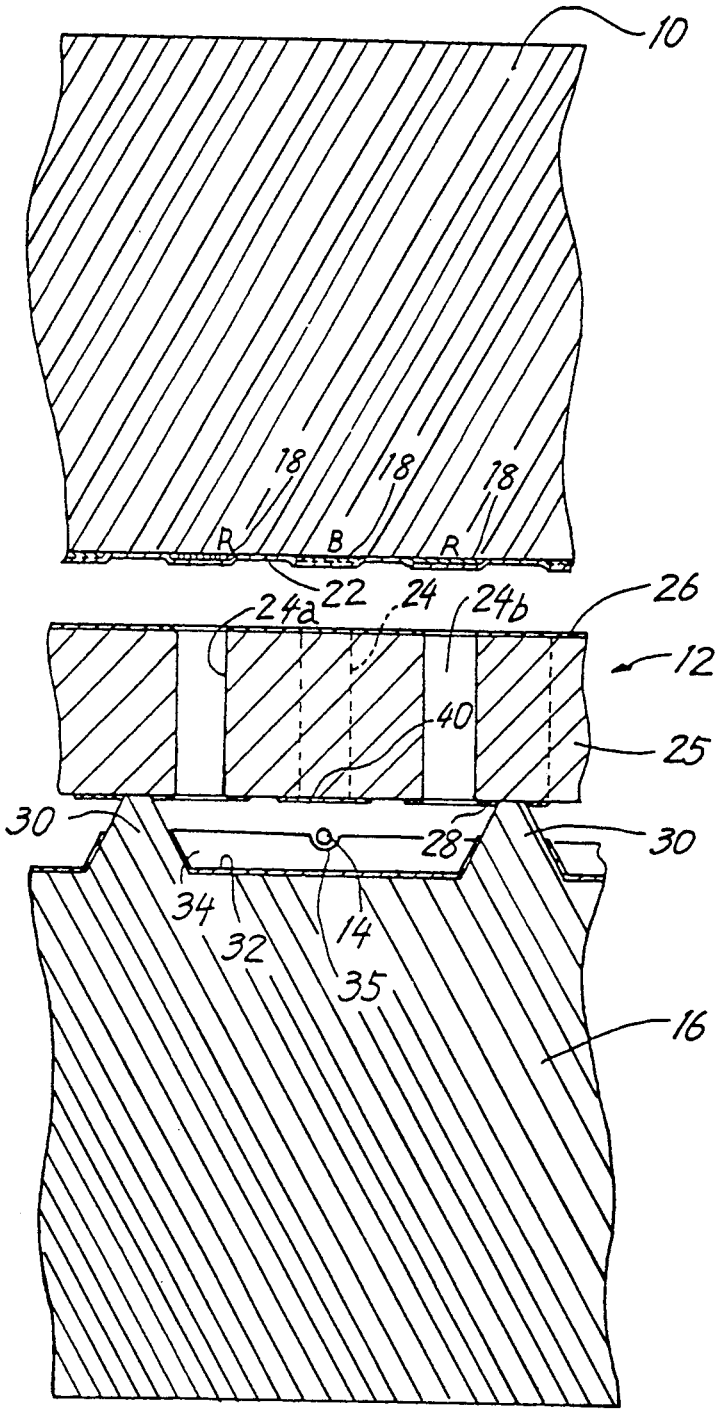
FIG. 2 is an enlarged fragmentary view in vertical section along the line II—II in FIG. 1 and showing the flat display as assembled.

The front panel 10 is a large panel measuring 880 mm in horizontal length, 497 mm in vertical length and 3 to 4 mm in thickness and is formed with phosphor dots 18 of the three primary colors, red, blue and green, as arranged regularly at a specified pitch over the entire inner surface (see FIG. 1A) . The inner surface of the front panel and the areas between the phosphor dots 18 are coated with carbon to ensure an improved contrast. The carbon coating and the dots are coated with a thin metal back layer 22 of aluminum as seen in FIG. 2 to prevent charging.

The rear panel 16 is made of a glass plate 3 to 4 mm in thickness and joined at its periphery to the inner surface of the front panel 10 to form a display panel unit.

Linear filament cathodes 14 held at their opposite ends by anchors 15, 15 (see FIG. 3) extend as tensioned over the inner side of the rear panel 16. The cathode 14 is in the form of a tungsten wire having a diameter of 30 to 50 micrometers and coated with an electron emitter material such as barium oxide and is held away from the rear panel 16 by the anchors 15 as shown in FIG. 2. As shown in FIG. 1A, the cathodes 14, 345 in number over the entire panel 16, are arranged in parallel at a spacing of every three horizontal (lateral in the illustration) rows of phosphor dots 18.

With reference to FIGS. 1 to 4, spacer ridges 30 having a height of about 0.3 mm to reach the address electrode plate 12 are formed on the inner surface of the rear panel and arranged between the respective filament cathodes 14. The spacer ridge 30 is tapered toward the address electrode substrate 12 and has opposite side faces which are inclined toward each other at the same angle with the surface of the rear panel 16.

As shown in FIG. 2, the inner surface of the rear panel 16 and the side faces of the entire lengths of spacer ridges 30 are covered with a metal film to form a back electrode 32.

An alternating current of 100 kHz with a central voltage of zero V and an amplitude of ±2 V is passed through the cathodes 14 to release free electrons, while the back electrode 32 is maintained at d.c. zero V or a slightly higher potential, facilitating release of electrons from the peripheries of the cathodes 14.

The address electrode plate 12 comprises a substrate 25 having a thickness of 1 mm and made of glass or a ceramic, first address electrodes 26 formed on one of the surfaces of the substrate 25 along the Y-direction (vertical direction) of an XY matrix and corresponding to the respective rows of phosphor dots 18 present in the same direction, and second address electrodes 28 formed on the other surface of the substrate 25 directed in the X-direction (horizontal direction) of the XY matrix, i.e. in a direction perpendicular to the first address electrodes 26, and corresponding to the rows of phosphor dots present in the same direction. The first address electrodes 26 are arranged in parallel and 3143 in number in corresponding relation to the number of phosphor dots arranged in the horizontal direction on the front panel 10. An address signal voltage in the horizontal scanning direction is applied to these electrodes in succession. On the other hand, the second address electrodes 28 are arranged in parallel and 1035 in number in corresponding relation to the number of phosphor dots arranged in the vertical direction. An address signal voltage in the vertical scanning direction is applied to these electrodes in succession.

The intersections of the two electrodes 26, 28 correspond to the respective phosphor dots 18 in position. Apertures 24, **24*a*, 24*b*, extending through the electrodes and the substrate, are formed in the address electrode plate 12 at the positions of the intersections over the entire area of the plate as shown in FIG. 2**.

The address electrode plate 12 is supported by the upper ends of the spacer ridges 30 at positions where the apertures 24, **24*a*, 24*b* are not closed therewith, and is adhered to the ridges when required for preventing warping and vibration. The electrode plate 12 is supported at a level of 0.3 mm from the inner surface of the rear panel 16**.

Figure 3:
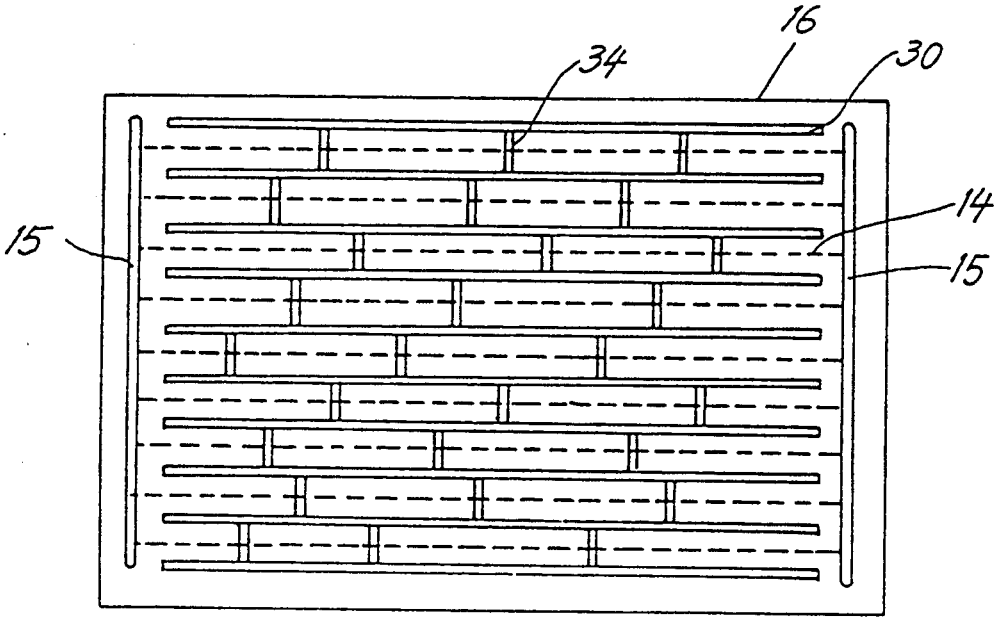
FIG. 3 is a plan view showing the inner surface of a rear panel.
Figure 4:
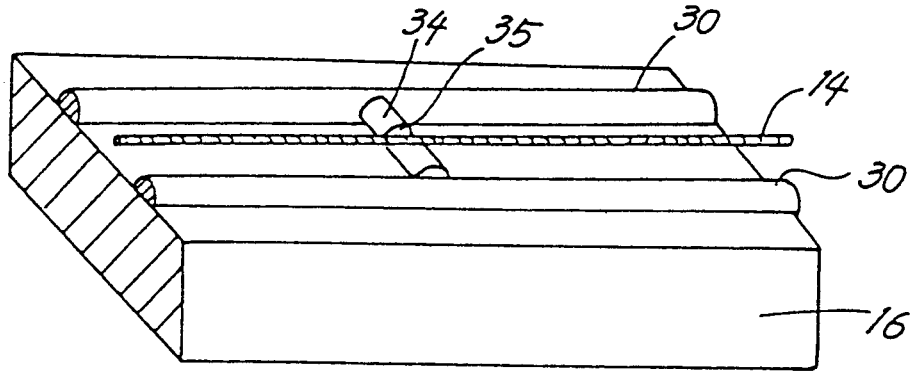
FIG. 4 is an enlarged fragmentary perspective view of the rear panel.

Further as seen in FIGS. 3 and 4, the adjacent spacer ridges 30 are interconnected by short auxiliary spacers 34 at several locations along the length thereof. The filament cathode 14 is fitted in a recess 35 formed in the top of the auxiliary spacer 34 at the midportion thereof and is prevented from contacting the second address electrode 28 when loosened or vibrated upward and downward. Since the cathode 14 is in point-to-point contact with the auxiliary spacer 34 at the recess 35, the cathode 14 undergoes almost any temperature drop due to heat transfer despite the contact and therefore releases electrons free of trouble.

Between the two spacer ridges 30, 30, three apertures 24, **24*a*, 24*b* are formed symmetrically with respect to the cathode 14, with the central aperture 24 positioned immediately above the cathode 14 as shown in FIG. 2, so that when the phosphor dot 18 immediately above the central aperture 24 is addressed, electrons can be released easily toward the addressed dot 18. Electrons also flow smoothly toward the phosphor dots at the opposite sides as will be described below since electron beams 40 temporarily extend sidewise and are then deflected toward the apertures 24*a*, 24*b* by being drawing by the electrodes 26, 28**.

Figure 5A:
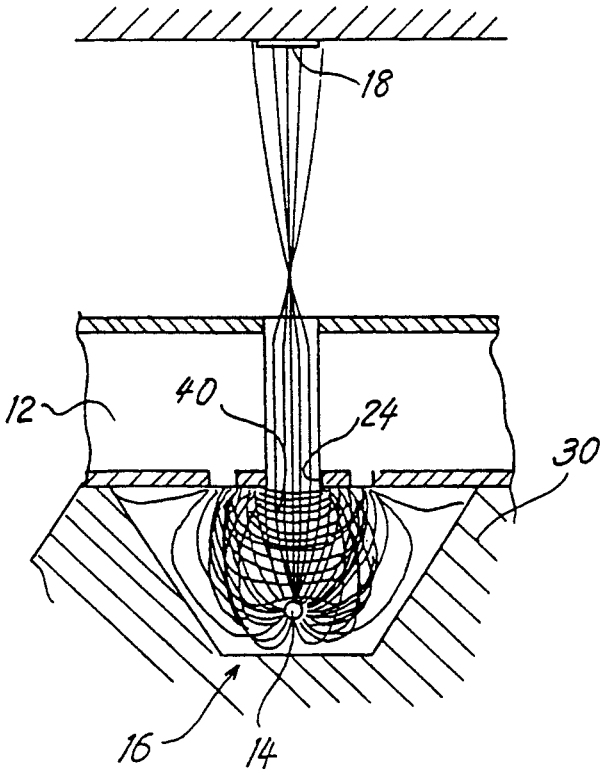
FIG. 5A and FIG. 5B are enlarged sectional views showing an electron beam as projected on a front panel when the spacer ridge has slanting side faces.
Figure 5B:
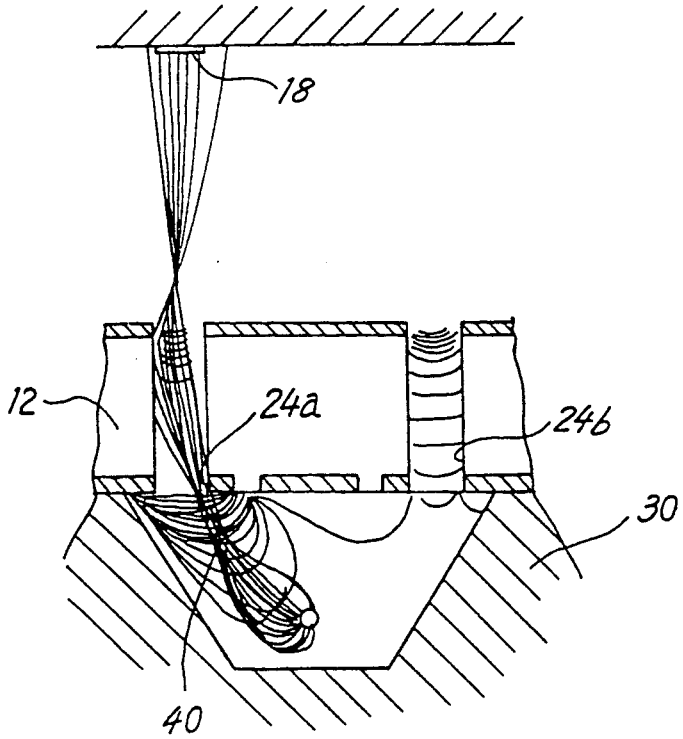

FIGS. 5A and 5B show electron orbits determined by computer simulation. FIG. 5A shows a case wherein a phosphor dot immediately above the cathode is addressed, and FIG. 5B a case wherein a phosphor dot at one side of the cathode is addressed.

In the case of FIG. 5B, an electron beam 40 flows sidewise free of trouble and impinges on the dot 18 in alignment with the aperture **24*a*. We have found that the area over which the fluorescent screen is irradiated with the electron beam 40 above the aperture is not different substantially between the case wherein the electron beam passes through the aperture immediately above the cathode as seen in FIG. 5A and the case where the beam passes through the side aperture 24*a* or 24*b* as shown in FIG. 5B**. Thus, the beam impinges on the picture element reliably to form a bright sharp image.

Figure 6A:
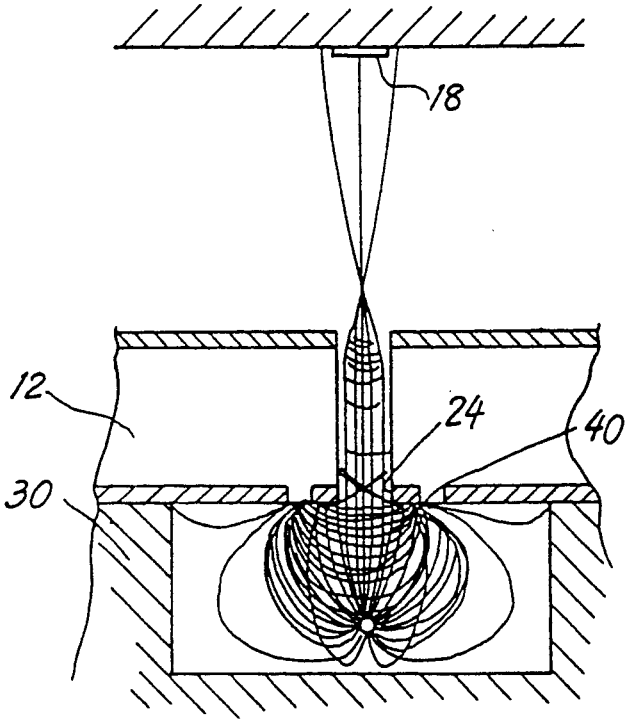
FIG. 6A and FIG. 6B are enlarged sectional views showing an electron beam as projected on the front panel when the spacer ridge has vertical side faces.
Figure 6B:
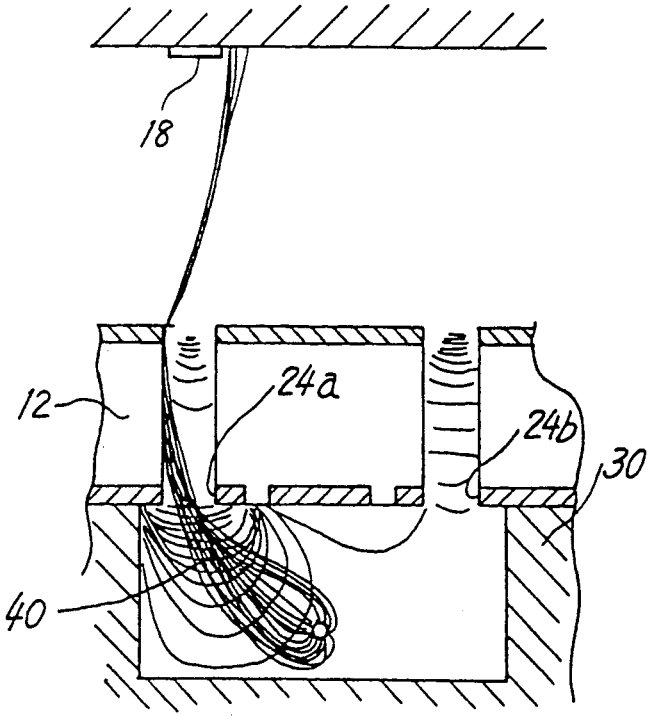

On the other hand, the result of simulation made in the case where the spacer ridge 30 has vertical side faces as seen in FIG. 6A and FIG. 6B indicates that the area of irradiation of the fluorescent screen differs with the position of the aperture for passing the electron beam 40 therethrough. This difference, if great, produces irregularities in the luminance of images.

The difference between the electron orbits appears attributable to the difference in the potential distribution in the portion defined by the spacer ridges 30, the rear panel 16 and the address electrode plate 12 between the slanting side faces of the spacer ridges 30 shown in FIGS. 5A and 5B and the vertical side faces of the ridges 30 in FIGS. 6A and 6B. It is thought that owing to the difference in the potential distribution, the orbit of electrons released from the filament cathode 14 so changes as to produce almost no change in the area of impingement of the electron beam on the front panel 10 regardless of whether the beam passes through the central aperture or the side aperture in the case of FIGS. 5A and 5B.

Figure 7:
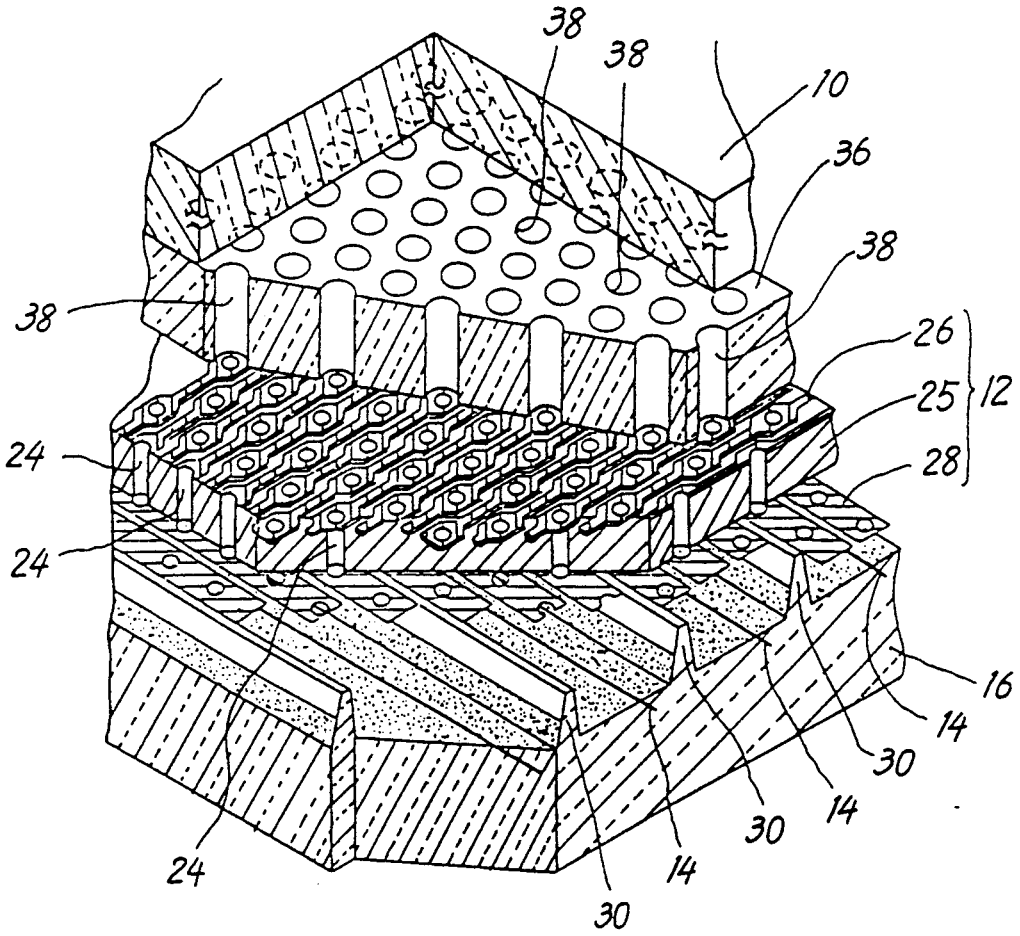
FIG. 7 is a perspective view partly broken away and showing a flat display having a spacer panel.

FIG. 7 shows another embodiment of the invention wherein the rear panel 16 is formed with spacer ridges 30, and a spacer panel 36 about 1 mm in thickness and made of glass, ceramic or like insulating material is disposed in the space between the front panel 10 and the address electrode plate 12. The spacer panel 36 has over the entire area thereof apertures 38 positioned in alignment with the respective apertures 24 of the electrode plate 12. Accordingly, the electron beam freely passes through the two apertures 24, 38 to impinge on the phosphor dot 18.

With the flat display of FIG. 7, the spacer ridges 30, the address electrode plate 12 and the spacer panel 36 are provided between the front panel 10 and the rear panel 16 to support the panels 10 and 16 and give remarkably improved pressure resistance to these panels.

Figure 8:
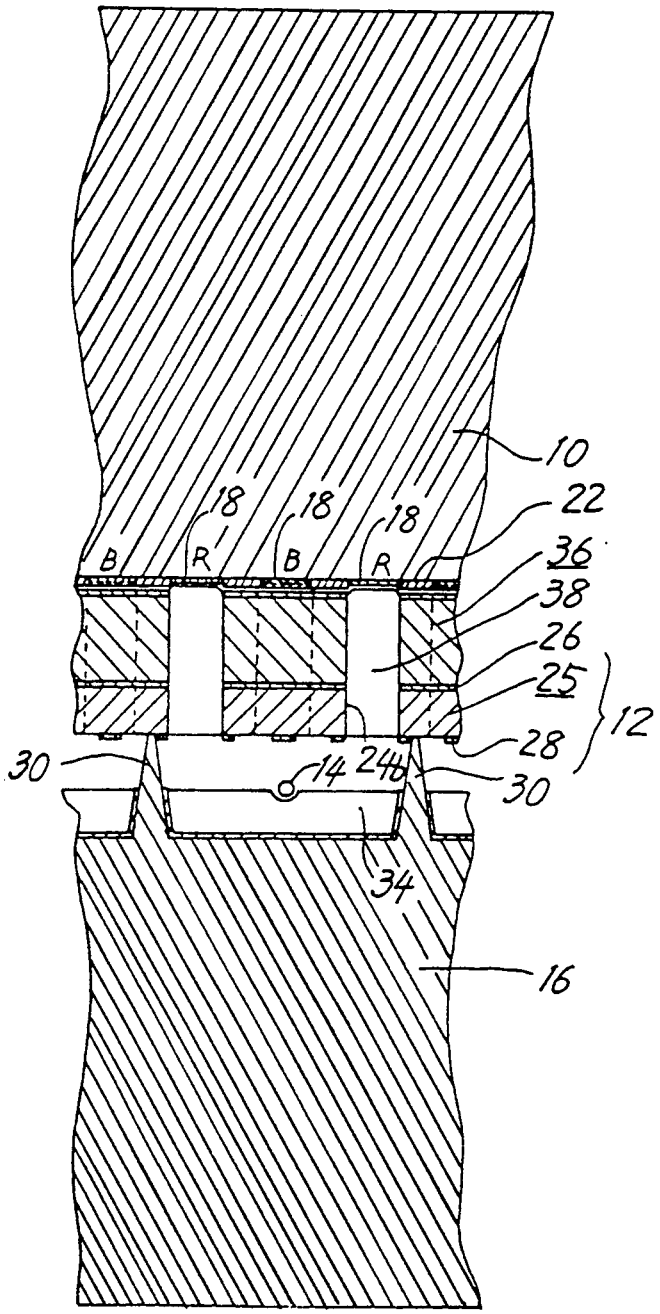
FIG. 8 is an enlarged fragmentary view in vertical section showing a flat display having a spacer panel with apertures of the same diameter as those in an address electrode plate.

FIG. 8 shows another embodiment of flat display comprising spacer ridges 30 and a spacer panel 36. The spacer panel 36 has apertures 38 having the same diameter as the apertures 24 of the address electrode plate 12.

Figure 9:
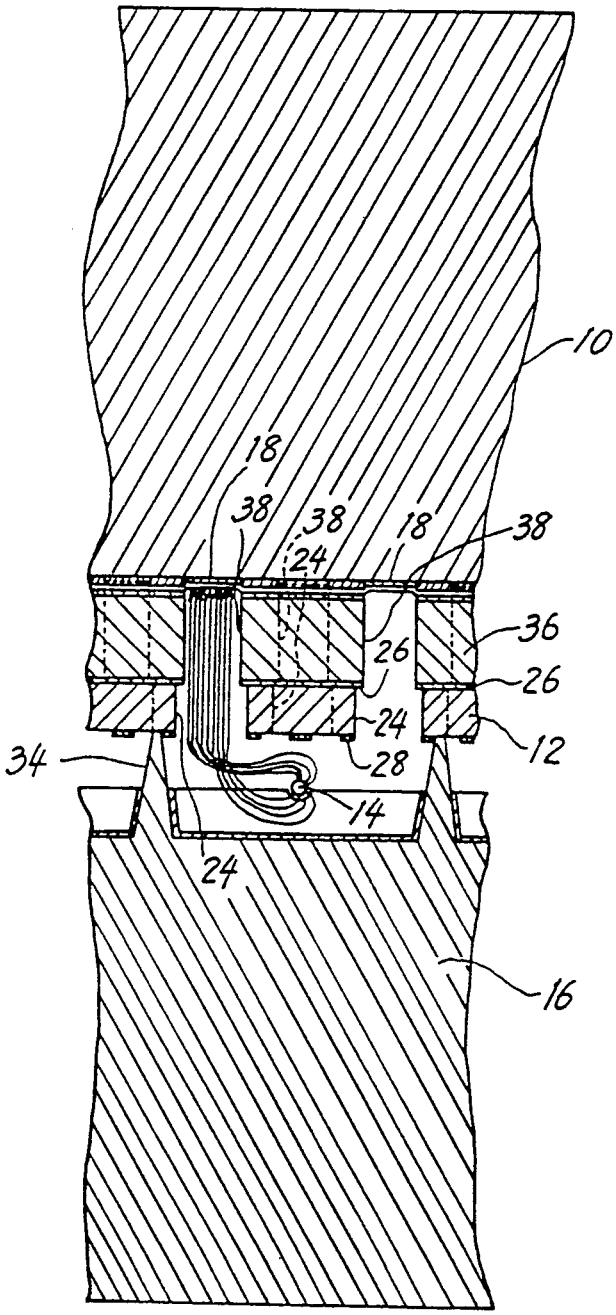
FIG. 9 is an enlarged fragmentary view in vertical section showing a flat display having a spacer panel with apertures of a smaller diameter than those in the address electrode plate.

FIG. 9 shows another embodiment which is an improvement of the embodiment of FIG. 8 in that the apertures 38 formed in the spacer panel 36 have a smaller diameter than the apertures 24 in the address electrode plate 12 and that the address electrodes 26 of XY matrix to positioned closer to the front panel are formed on the lower surface of the spacer panel 36.

With the embodiment of FIG. 9, the address electrodes 26 are exposed to the interior of the apertures 24 of the electrode plate 12 over an increased area, so that the electron beam can be drawn easily. The voltage to be applied to the address electrodes 26 can therefore be lowered to achieve a reduction in power consumption.

When the fluorescent screen luminesces monochromatically, the apertures 24, 38 to be formed in the address electrode plate 12 and the spacer panel 36, respectively, are identical with the picture elements on the screen in size and pitch. In this case, the spacer ridges 30 to be formed on the inner surface of the rear panel 16 are arranged at a spacing of one pitch or a plurality of pitches of the picture elements.

Figure 10A:
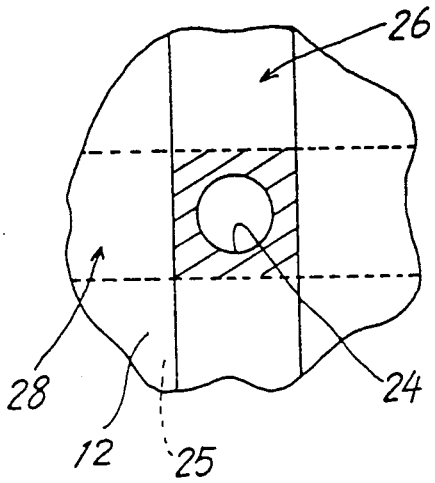
FIGS. 10A, 10B and 10C are diagrams showing the position relationship between an aperture and two address electrodes.
Figure 10B:
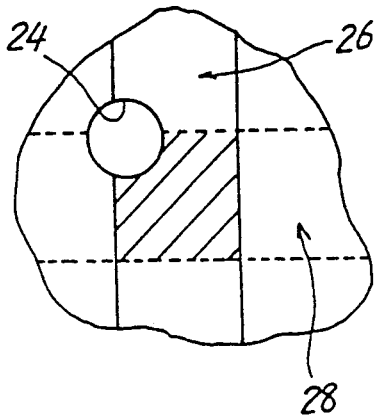
Figure 10C:
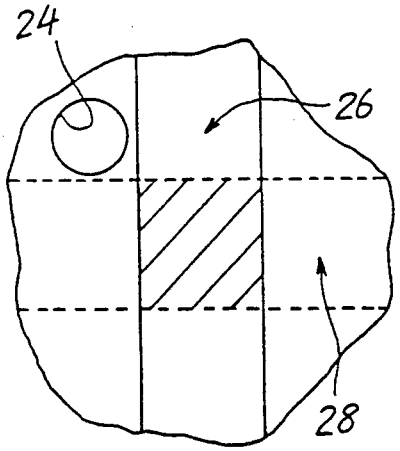

With the above embodiment, the intersection of the first address electrode 26 and the second address electrode 28 on opposite sides of the substrate 25 of the electrode plate 12 is formed with one aperture 24 centrally of the intersection as shown in FIG. 10A. Owing to an accumulation of errors in making the apertures and the electrodes of the embodiment, it is likely that the aperture 24 is positioned away from the center of the intersection of the electrodes 26, 28 as seen in FIG. 10B. In an extreme case as in FIG. 10C, the aperture 24 is formed completely outside the electrode intersection. This means that the corresponding picture element totally fails to luminesce to produce images of impaired quality.

This problem can be overcome by forming a multiplicity of apertures 24 in the substrate 25 of the electrode plate 12 in a close arrangement without any lapping of the adjacent apertures with at least one aperture formed in each of the intersections of the electrodes 26, 28.

Figure 11:
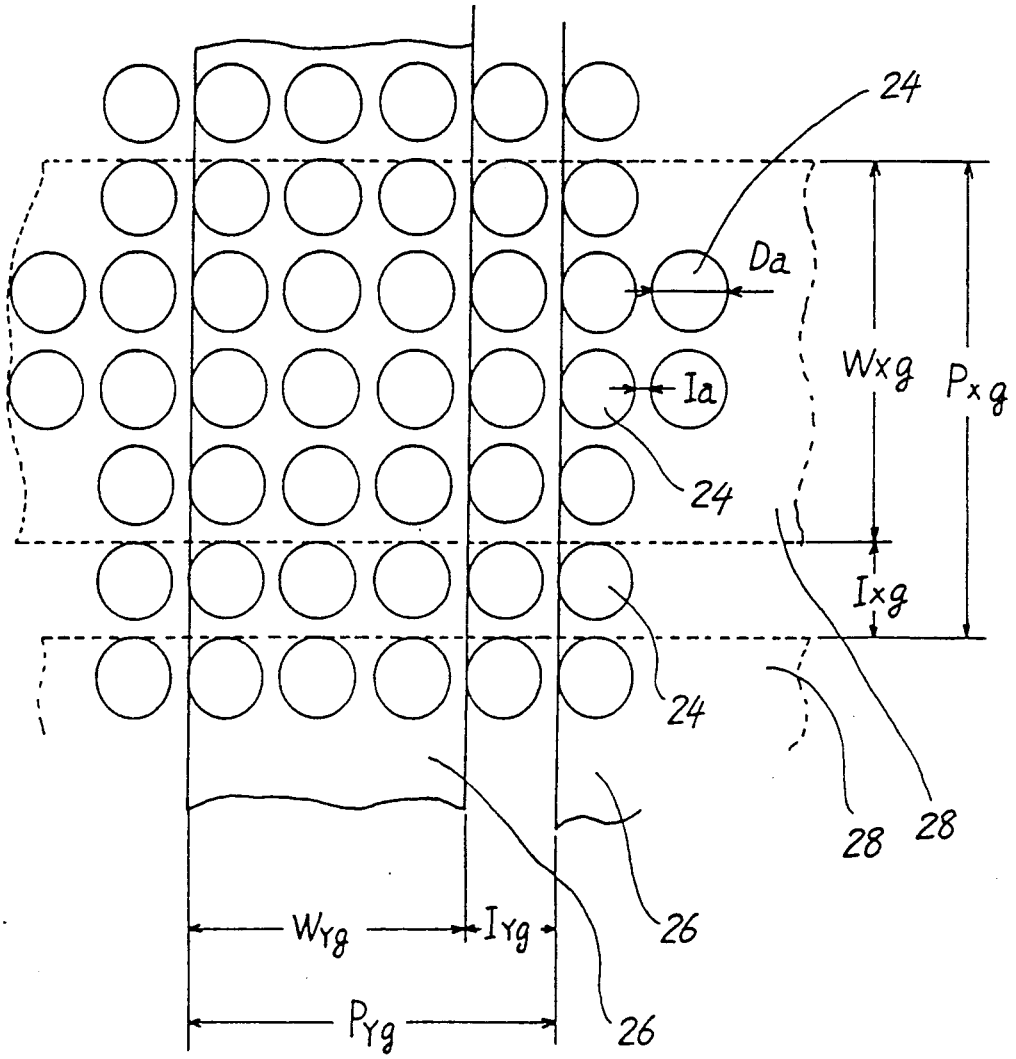
FIG. 11 is a diagram of an arrangement of circular apertures.

For example in the case where the apertures 24 are circular in cross section, suppose the diameter of the apertures 24 is Da, the shortest distance between the adjacent apertures is Ia, the width of the second address electrode 28 is Wxg, the clearance between the electrodes 28, 28 is Ixg, the pitch of the second address electrodes is Pxg, the width of the first address electrode 26 is Wyg, the clearance between the electrodes 26, 26 is Iyg, and the pitch of the first address electrodes is Pyg as shown in FIG. 11. These dimensions are to be determined as follows.

$$Wxg=k\times(Da+Ia)$$

$$Ixg=1\times(Da+Ia)$$

$$Pxg=(k+1)\times(Da+Ia)$$

$$Wyg=m\times(Da+Ia)$$

$$Iyg=n\times(Da+Ia)$$

$$Pyg=(m+n)\times(Da+Ia)$$

wherein k, 1, m and n are each an integer.

Thus, the width and pitch of and the clearance between the first electrodes 26, as well as the second electrodes 28, are each so determined as to be equal to the sum of the diameter of the aperture 24 and the shortest distance between the adjacent apertures 24, i.e. (Da+Ia), multiplied by an integer. In the case of FIG. 11, k=3, l=1, m=4 and n=1.

FIG. 12 shows an embodiment wherein the apertures 24 are rectangular in cross section. Suppose the width of the aperture 24 in the direction of the first address electrode 26 is Wax, the width thereof along the second address electrode 28 is Way, the distance between the apertures which arc adjacent to each other in the direction of the address electrode 26 is Iax, the distance between the apertures adjacent to each other in the direction of the second address electrode 28 is Iay, the width of the second address electrode 28 is Wxg, the clearance between the electrodes 28 is Ixg, the pitch thereof Pxg, the width of the first address electrode 26 is Wyg, the clearance between the electrodes 26 is Iyg, and the pitch thereof is Pyg. These dimensions are to be determined as follows.

$$Wxg=k\times(Wax+Iax)$$

$$Ixg=1\times(Wax+Iax)$$

$$Pxg=(k+1)\times(Wax+Iax)$$

$$Wyg=m\times(Way+Iay)$$

$$Iyg=n\times(Way+Iay)$$

$$Pyg=(m+n)\times(Way+Iax)$$

wherein K, 1, m and n are each an integer.

Thus, the width Wxg of the second address electrode 28, the distance Ixg between the electrodes 28, 28 and the pitch Pxg thereof are each so determined as to be equal to the sum of the width Wax of the aperture 24 in the direction of the address electrode 26 and the clearance Iax between the apertures adjacent along the first address electrode 26, i.e. $(Wax+Iax)$, multiplied by an integer. The width Wyag of the first address electrode 26, the clearance Iyg between the electrodes 26 and the pitch Pyg thereof are each so determined as to be equal to the sum of the width Way of the aperture 24 in the direction of the second address electrode 28 and the clearance Iay between the apertures adjacent along the second address electrode 28, i.e. (Way+Iay), times an integer. In the case of FIG. 12, k=3, l=1, m=4 and n=1.

Figure 13:
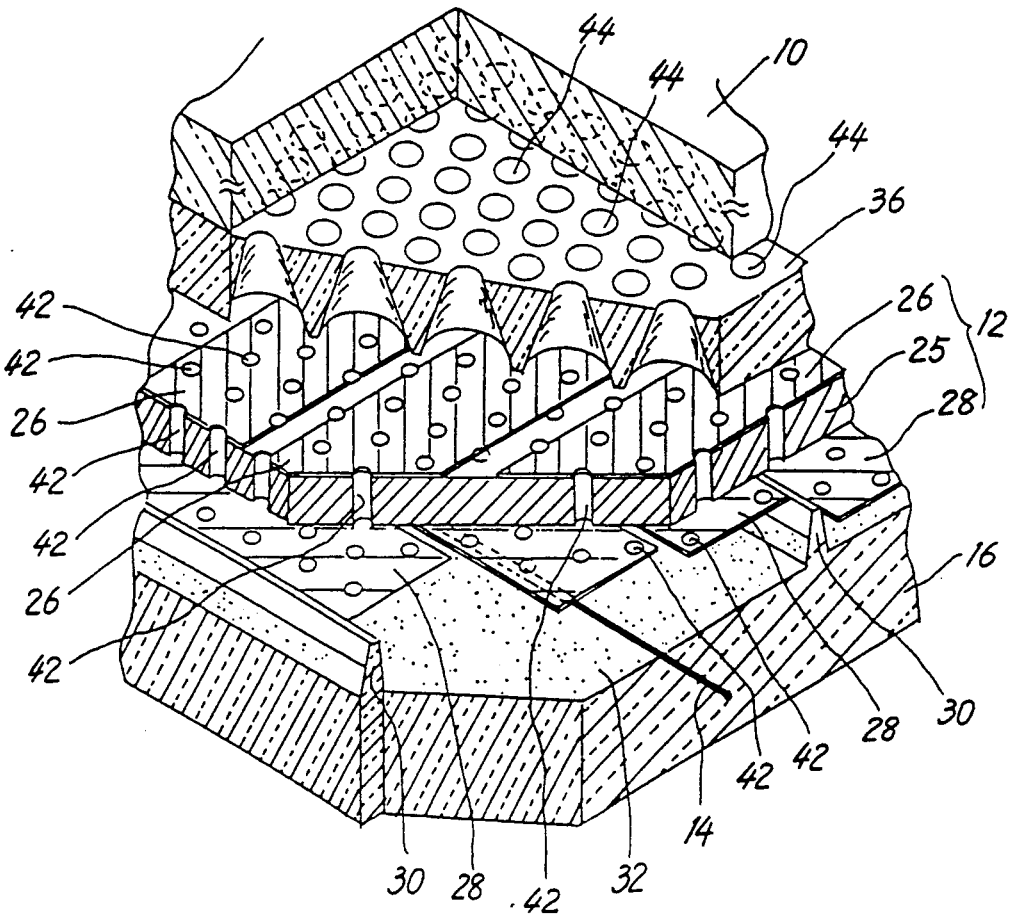
FIG. 13 is a perspective view partly broken away and showing a flat display having a spacer panel with tapered apertures.
Figure 14:
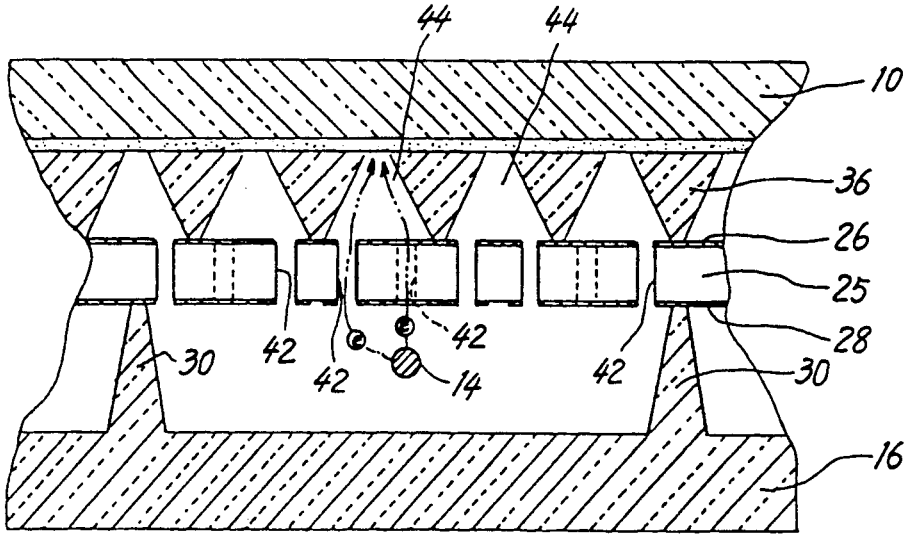
FIG. 14 is a fragmentary view in vertical section of the flat display of FIG. 13.

FIGS. 13 and 14 show a flat display wherein a multiplicity of apertures 42 are formed in the address electrode plate 12 at a small pitch so that at least one aperture is present at each of the intersections of the electrodes 26, 28. In the illustrated case, 12 apertures 42 are formed in the area of each intersection.

With this flat display, the spacer panel 36 is formed with apertures 44 at the same pitch as the pitch of phosphor dots on the front panel 10. The apertures 44 are tapered from one side of the panel 36 close to the electrode plate 12 toward the other side thereof close to the front panel 10, with a cross section diminishing in this direction. At the electrode plate side, the apertures 44 have the largest possible area without overlapping, and the opening area is sufficiently greater than the aperture 42 in the address electrode plate 12.

Accordingly, even if the aperture 44 of the spacer panel 36 is displaced from the corresponding aperture 42 of the electrode plate 12, electrons are assured of a sufficiently large region to pass through.

Figure 15:
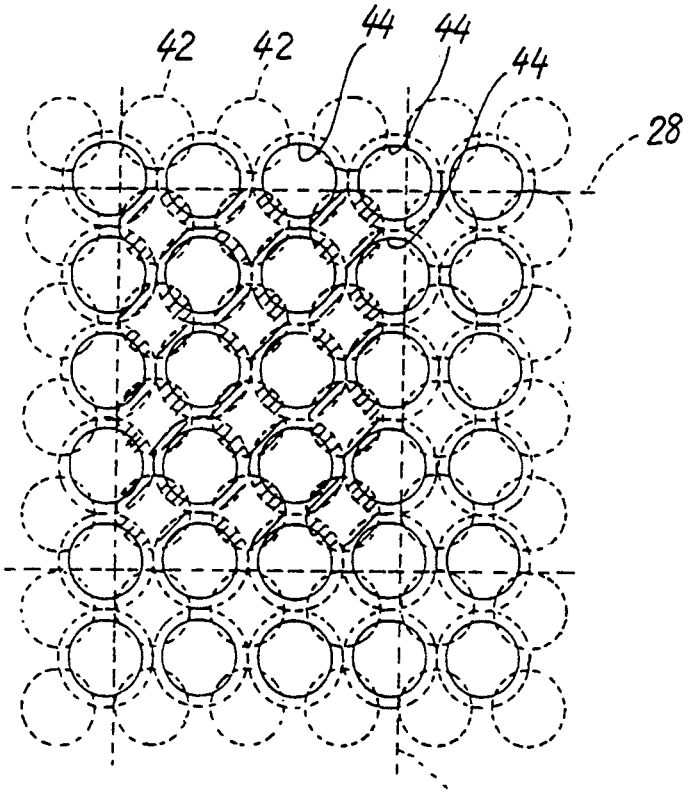
FIG. 15 is a plan view showing the flat display of FIG. 13 wherein the spacer panel apertures are displaced to the greatest extent from the address electrode plate.
Figure 16:
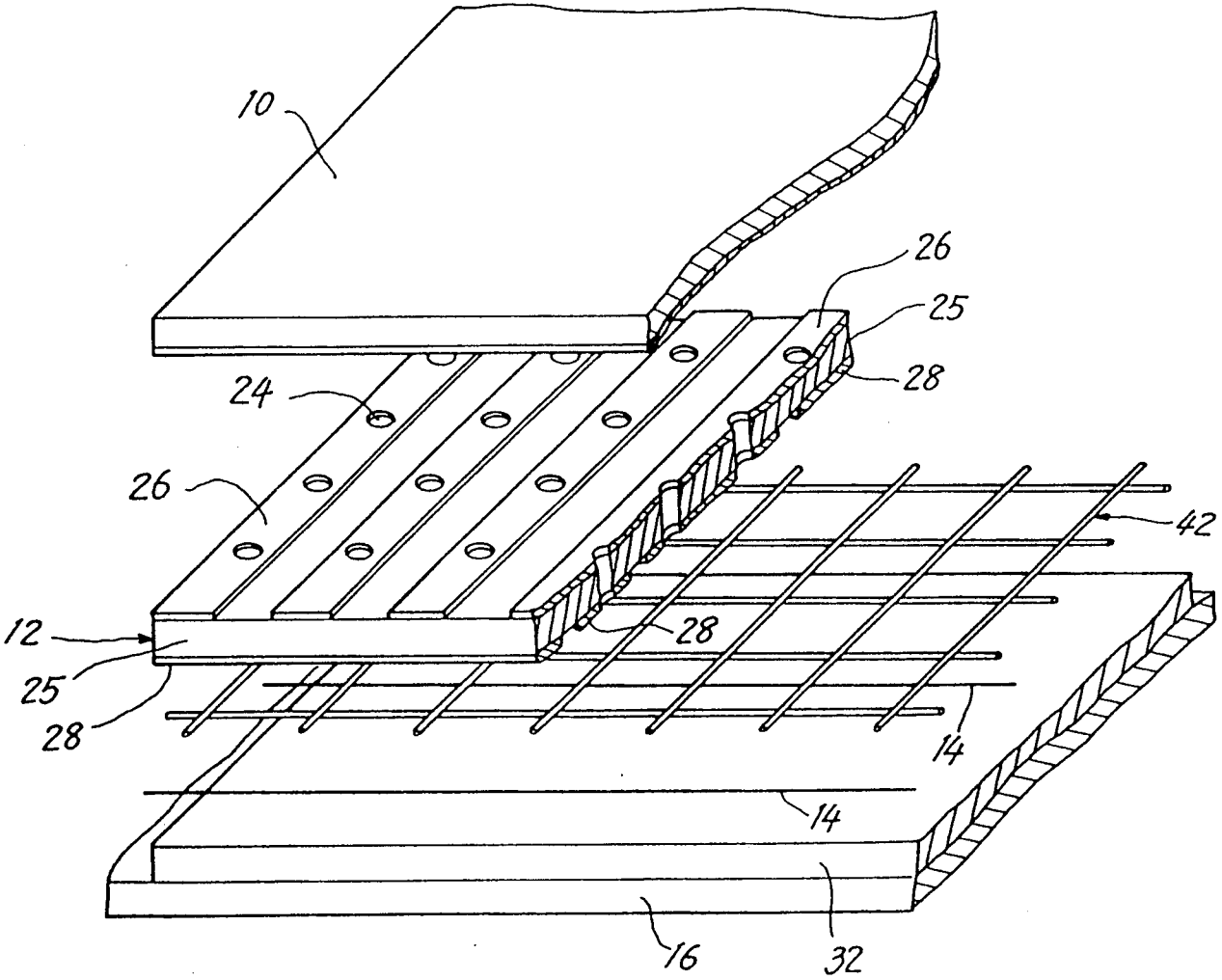
FIG. 16 PRIOR ART
FIG. 16 is an exploded perspective view partly broken away and showing a conventional flat display.

For example, even in the worst case where the two apertures 42, 44 are displaced to the greatest extent as shown in FIG. 15, the hatched areas for electrons to pass through straight are sufficiently large to excite the phosphor dot.

When an address signal voltage is applied to the address electrodes 26, 28 of the electrode plate 12 in the above flat display, electrons are drawn from the filament cathode 14 most proximate to the addressed position, dividedly passed through a plurality of apertures 42 at the addressed position of the electrode plate 12, then guided through the aperture 44 in the spacer panel 36 and efficiently irradiate the phosphor at the corresponding position on the front panel 10.

Accordingly, the flat display of FIG. 13 not only has improved strength against pressure due to the provision of the spacer ridges 30 and the spacer panel 36 but also affords sharp images without irregularities in luminescence.

The drawings and the foregoing description of the embodiments are intended to illustrate the present invention and should not be interpreted as limiting the claimed invention or reducing the scope of the invention.

The construction of the displays of the invention is not limited to the foregoing embodiments but can of course be modified variously by one skilled in the art without departing from the scope of the invention as defined in the appended claims.

What is claimed is:

1. A flat display comprising:

a front panel having a fluorescent screen on a rear surface, the fluorescent screen including an arrangement of rows of phosphors, each row having three primary colors, each primary color arranged in a column;

a rear panel opposed to the front panel in parallel thereto to define a flat hermetic space with the front panel and having a back electrode on a surface facing the front panel;

a plurality of linear filament cathodes arranged close to an inner surface of the rear panel in parallel thereto, the linear filament cathodes arranged for every three rows of the phosphors and in parallel to said rows;

an address electrode plate disposed in a vicinity of an inner surface of the front panel in parallel to the front panel, the address electrode plate having a plurality of first address electrodes extending in parallel to one another and formed on one surface of a substrate in a form of a planar plate, a plurality of second address electrodes formed on another surface of the substrate and extending in parallel to one another in a direction intersecting the first address electrodes, and one or a plurality of apertures formed at each position where the first address electrodes and the second address electrodes overlap each other with the substrate provided therebetween; and a plurality of spacer ridges formed on the inner surface of the rear panel, the spacer ridges extending along the linear filament cathodes and arranged for every linear filament cathode, the spacer ridges having a height to reach the address electrode plate, wherein three rows of the phosphors, between the spacer ridges, are formed symmetrically with respect to each linear filament cathode, a central row of the phosphors positioned immediately above each linear filament cathode.

2. A flat display as defined in claim 1 wherein each of the spacer ridges has a width gradually decreasing toward the address electrode plate and opposite side faces inclined with respect to the surface of the rear panel.

3. A flat display as defined in claim 1 wherein a spacer panel, formed with apertures positioned in alignment with respective apertures of the address electrode plate, is disposed between the address electrode plate and the front panel, and the front panel and the rear panel are supported by the spacer panel, the address electrode plate and the spacer ridges prevent the flat display from implosion.

4. A flat display comprising:

a front panel having a fluorescent screen on a rear surface;

a rear panel opposed to the front panel in parallel thereto to define a flat hermetic space with the front panel and having a back electrode on a surface facing the front panel;

a plurality of liner filament cathodes arranged close to an inner surface of the rear panel in parallel thereto; and an address electrode plate disposed in a vicinity of an inner surface of the front panel in parallel to the front panel, the address electrode plate having a plurality of first address electrodes extending in parallel to one another and formed on one surface of a substrate in a form of a planar plate, a plurality of second address electrodes formed on another surface of the substrate and extending in parallel to one another in a direction intersecting the first address electrodes, and a multiplicity of apertures formed in the electrode plate over an entire area thereof and so arranged that a plurality of the apertures are present at each position where each first address electrode overlaps each second address electrode with the substrate provided therebetween.

5. A flat display as defined in claim 4 wherein the rear panel is formed on the inner surface with a plurality of spacer ridges extending along the linear filament cathodes and arranged for every filament cathode or every plural number of filament cathodes, and the spacer ridges have a height to reach the address electrode plate.

6. A flat display as defined in claim 4 wherein a spacer panel is disposed in a flat space between the address electrode plate and the front panel, and the spacer panel is formed over an entire area thereof with a multiplicity of apertures having a cross section diminishing from a side facing the electrode plate toward a side facing the front panel.

* * * * *